United States Patent [19]

Zalewski et al.

[11] Patent Number: 4,488,020

[45] Date of Patent: Dec. 11, 1984

[54] MINIATURE MULTI-POLE DOUBLE-THROW SNAP-ACTION PUSHBUTTON SWITCH WITH ALPHA-NUMERIC DISPLAY

[75] Inventors: Jack J. Zalewski; Walter C. Theurer, both of Bradenton, Fla.

[73] Assignee: Eaton Corporation, Cleveland, Ohio

[21] Appl. No.: 468,925

[22] Filed: Feb. 23, 1983

[51] Int. Cl.[3] ..... H01H 13/26; H01H 9/00

[52] U.S. Cl. ..... 200/76; 200/314; 200/67 D; 200/153 LA; 200/292

[58] Field of Search ..... 200/76, 292, 77, 68, 200/67 G, 67 D, 67 DA, 67 R, 302, 153 LA, 153 L, 314; 340/635, 638, 644

[56] References Cited

U.S. PATENT DOCUMENTS

| | | | |
|---|---|---|---|
| 1,306,852 | 6/1919 | Klein | 200/77 |
| 2,222,963 | 11/1940 | Tregoning | 200/76 |
| 2,326,232 | 8/1943 | Krieger | 200/157 |
| 2,399,867 | 5/1946 | Hetherington | 200/67 |
| 2,412,119 | 12/1946 | Bentley | 200/76 |
| 2,420,913 | 5/1947 | Schellman | 200/76 |
| 2,430,189 | 11/1947 | Schellman | 200/77 X |
| 2,535,090 | 12/1950 | O'Brien et al. | 200/76 |
| 2,571,170 | 10/1951 | Stilwell, Jr. | 200/76 |
| 2,967,218 | 1/1961 | Dorjee | 200/76 |
| 3,117,330 | 4/1965 | Lundberg | 200/241 |
| 3,187,133 | 6/1965 | Pierce | 200/159 R |
| 3,264,884 | 8/1966 | Brooker | 200/76 |
| 3,566,057 | 2/1971 | Reinke | 200/76 |
| 3,623,047 | 11/1971 | Stallebrass | 340/644 X |
| 3,632,921 | 1/1972 | Korsgren | 200/76 |
| 3,764,762 | 10/1973 | Roeser | 200/68 |
| 4,017,122 | 5/1977 | Bevacqua | 200/77 |
| 4,104,494 | 8/1978 | Swann | 200/67 G |

*Primary Examiner*—Stephen Marcus
*Assistant Examiner*—Ernest G. Cusick
*Attorney, Agent, or Firm*—C. H. Grace; W. A. Autio

[57] ABSTRACT

A reduced size pushbutton (6) switch having a plurality of contact pairs (40, 42, 44, 46) arranged angularly for radial actuation by normally-open cams (34*c*) or normally-closed cams (34*d*) on a vertically reciprocated actuator block (34) by a snap-action mechansim (30*c*, 30*d*, 36, 38 or 66, 68*a*). The contact pairs are electrically connected to a control circuitry PC board (52) which provides an output control as well as controlling a multi-character alpha-numeric display mounted within the pushbutton. This display includes a light source (22), a display (24) and movable (14) and stationary (12) contacts connecting the light source to a display drive PC board (10) which may be connected to the control circuitry PC board to afford control of the display by some of the contact pairs. A seal (8) between the front panel and the display PC board hugs the pushbutton to prevent dirt from entering the switch base (54).

13 Claims, 10 Drawing Figures

MINIATURE MULTI-POLE DOUBLE-THROW SNAP-ACTION PUSHBUTTON SWITCH WITH ALPHA-NUMERIC DISPLAY

BACKGROUND OF THE INVENTION

Lighted pushbutton switches and lighted displays have been known heretofore. They have been typically illuminated by incandescent bulbs and employed hot stamped filled legends. Those devices having changeable lengends employed some form of preprinted changeable mask with limited legends. However, these prior devices have been handicapped in that changing the color and the legend was costly and very limited. Those prior devices employing incandescent light bulbs also generated a large amount of heat. In addition, multi-pole switches of the prior type were too large, particularly in their vertical height. Moreover, the wiring to the indicator was too bulky. While the prior devices have been useful for their intended purposes, this invention relates to improvements thereover that not only overcome the aforesaid disadvantages of the prior devices but also provide additional desirable features hereinafter more fully described.

SUMMARY OF THE INVENTION

An object of the invention is to provide an improved miniature multi-pole double-throw snap-action pushbutton switch with alpha-numeric display.

A more specific object of the invention is to provide a reduced size compact multi-pole snap-action switch.

Another specific object of the invention is to provide a switch of the aforementioned type having longer life and longer actuator block travel.

Another specific object of the invention is to provide a switch of the aforementioned type wherein the contact pressure can be controlled very accurately because it does not use a contact carrier.

Another specific object of the invention is to provide a switch of the aforementioned type having a cam and contacts combination structure which keeps the stresses very low therby ensuring a long life for the switch.

Another specific object of the invention is to provide a switch of the aforementioned type that is shorter overall in height.

Another specific object of the invention is to provide a switch of the aforementioned type wherein the actuator cam block may be square, rectangular, hexagonal, octanonal or other shape for operating any odd or even number of a plurality of contact sets some of which can control a load circuit and others of which can control a plural-character pushbutton display thereby enabling control of multiple circuitry with one pushbutton switch.

Another specific object of the invention is to provide a compact switch of the aforementioned type that can use more than one or a multi-layer printed circuit board thereby to reduce the overall size of the switch unit.

Another specific object of the invention is to provide an improved pushbutton switch of the aforementioned type which can use LED's, LCD's, incandescent lamp bulbs or the like in the indicator display.

Another specific object of the invention is to provide an improved switch of the aforementioned type wherein the switch functions can be altered by repositioning the actuator cam, normally-open to normally-closed and normally-closed to normally-open, without disconnecting the wires from the terminals and reconnecting the same.

Other objects and advantages of the invention will hereinafter appear.

DESCRIPTION OF THE PREFERRED EMBODIMENTS

Figure 1:
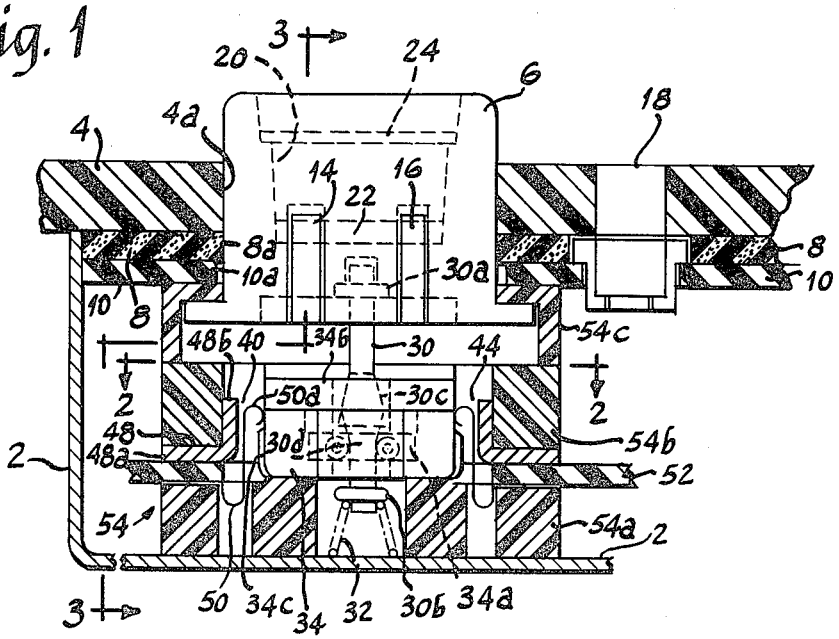
FIG. 1 is an enlarged cross-sectional view of a miniature multi-pole double-throw snap-action pushbutton switch with alpha-numeric display showing the internal mechanism thereof.
Figure 2:
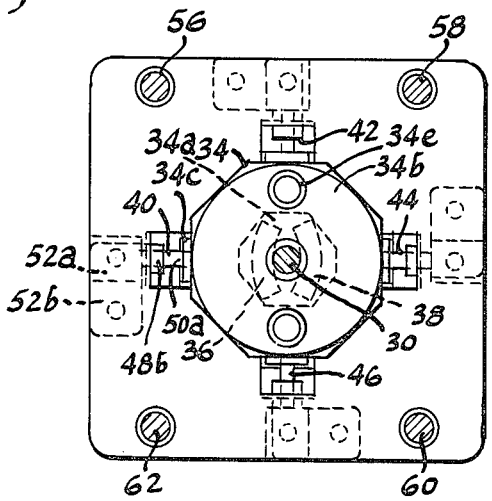
FIG. 2 is a cross-sectional view taken substantially along line 2—2 of FIG. 1, showing another view of the internal mechanism thereof.
Figure 3:
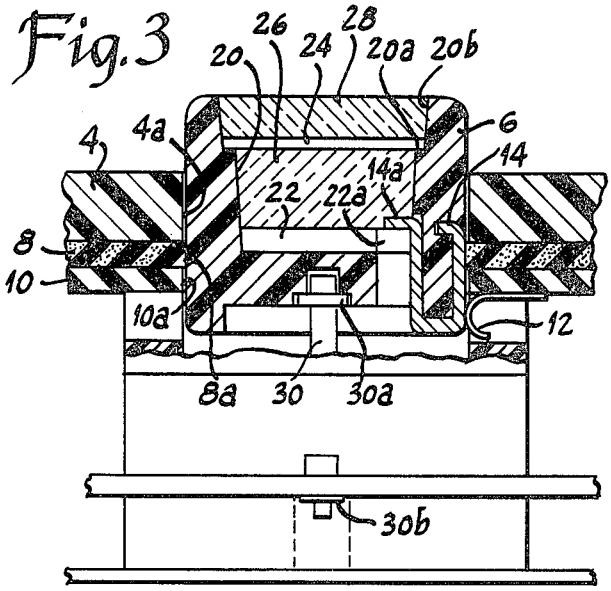
FIG. 3 is a partial cross-sectional view taken substantially along line 3—3 of FIG. 1 showing the brush contact sets that connect to the display.
Figure 5:
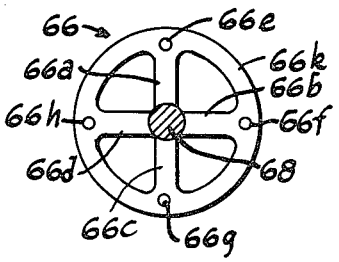
FIG. 5 is a top plan view of a preferred form of a snap-action over-center spring used in the switch of FIG. 6.
Figure 6:
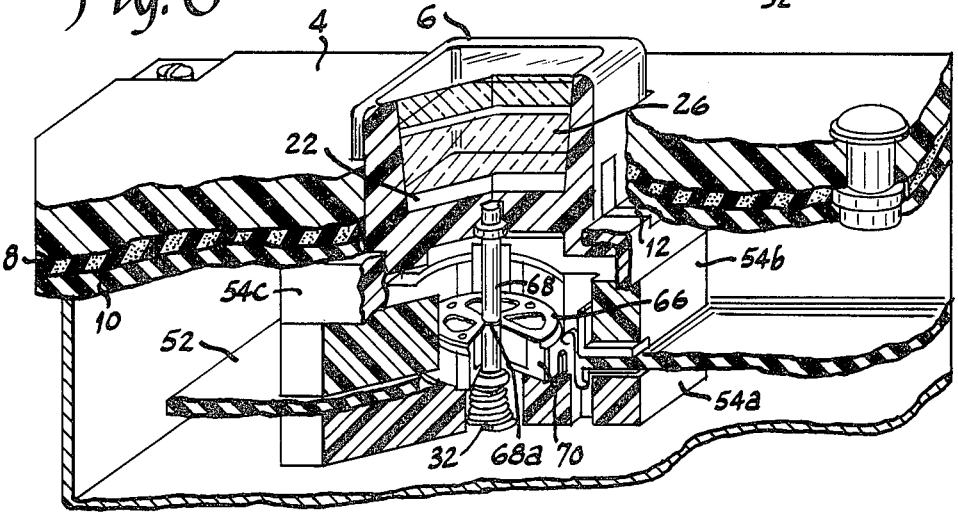
FIG. 6 is an enlarged cross-sectional view of the preferred form of switch, showing the internal mechanism thereof, and using the over-center compression spring of FIG. 5.

Referring to the drawings, FIGS. 1–4 show a first form of the invention using an over-center mechanism having a double inclined cam on the pushbutton shaft and a pair of helical springs for snapping the actuator cam block up or down whereas FIGS. 5–6 show a preferred form of the invention using a quadri-compression-spring overcenter mechanism. As shown in FIG. 1, the switch is provided with a housing 2 closed by a cover 4 having a hole **4*a* therein through which pushbutton 6 of the switch extends for manual actuation by the user or cover 4 may be a mounting panel that accommodates a plurality of switches similar to that shown in FIG. 4 in spaced apart arrangement. An environmental seal 8, that is, a seal that excludes dirt, dust and moisture, underlies panel 4 and hugs pushbutton 6 to prevent dirt of the aforementioned type from entering around the pushbutton into housing 2. A printed circuit board 10 underlies seal 8 and is electrically connected to the display elements within the pushbutton by a plurality of contact sets, each having a stationary brush contact 12 mounted below and secured to printed circuit board 10 as shown in FIG. 3 and a movable contact 14 mounted on the pushbutton. Another movable contact 16 is shown in FIG. 1 mounted on the pushbutton is spaced relation to movable contact 14 so that it will be apparent that a plurality of similar contact sets may be spaced around the pushbutton for making electrical connections from the printed circuit board to the display within the pushbutton. When the pushbutton is depressed, the outer face of movable contact 14 slides on the curved, compression portion of stationary brush contact 12** to maintain electrical contact therebetween throughout the pushbutton travel.

As shown in FIG. 1, a warning light socket 18 may be provided in panel 4 and also extending through seal 8 and printed circuit board 10 and connected to the printed circuit board to be lighted as a warning signal by one of the switch contact sets or upon application of power to the panel or the like.

As shown in FIGS. 1 and 3, pushbutton 6 is provided with a recess or pocket 20 extending down from the top thereof which is filled with the following elements. At the bottom of this pocket is a planar source of illumination or light source 22 which may include different color LED's (light emitting diodes), incandescent lamps, LCD's (liquid crystal display) or the like. The terminals 22*a* of the light elements on light source 22 are at the edge thereof where they are connected to right angle inner end portion 14*a* of movable contact 14. Pocket 20 is slightly flared upwardly and partway up has a shoulder 20*a* whereabove the pocket terminates in a larger size 20*b*. A planar indicia display plate 24 rests on shoulder 20*a* and the space therebelow is filled with a plastic epoxy 26 or the like. Alternatively, a single or multi-color LED or LCD display may be used in place of plate 24 and connected to contacts 14, 16, etc. for energization, in which case illumination source 22 is not required. The space above display 24 is filled with a clear or translucent plastic epoxy 28 level with the top of the pushbutton to provide a smooth surface thereon. As will be apparent, when the pushbutton is depressed, it is guided by and slides smoothly within hole 4*a* in panel 4 and is provided clearance by a corresponding hole 10*a* in printed circuit board 10. Seal 8 has a slightly smaller hole 8*a* therein so that it resiliently hugs pushbutton 6 to seal the switch housing from the outside.

As shown in FIGS. 1 and 3, switch actuator shaft 30 has a flange 30*a* near its upper end whereby it is seated in a stepped blind hole in the lower end of pushbutton 6. A similar flange 30*b* is provided near the lower end of operating shaft 30 for retaining the upper, smaller end of a frusto-conical return spring 32, the larger, lower end of which abuts the bottom of housing 2. The midportion of operating shaft 30 is provided with integral double inclined, frusto-conical surfaces 30*c* and 30*d*. Actuator cam block 34 is provided with an internal pocket 34*a* shown in FIG. 2 which is partially covered by a top plate 34*b*. As shown in FIG. 2, this pocket 34*a* has a configuration so that it retains a pair of helical springs 36 and 38 and presses them against opposite sides of operating shaft 30 with sufficient clearance at the midpoints of these two springs to allow the double inclined cam portion 30*c–d* of the operating shaft to be pressed over-center therebetween thereby to snap actuator cam block 34 up when the pushbutton is depressed and to snap it back down when the pushbutton is released. Alternatively, a single circular helical garter spring could be used in place of helical springs 36 and 38.

Figure 4:
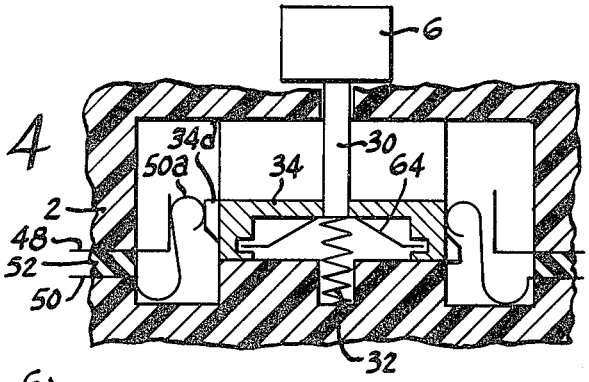
FIG. 4 is an enlarged schematic cross-sectional view of the switch incorporating a rotated or modified actuator cam block providing for both normally-open and normally-closed contacts in a double-throw version of the switch.

Actuator cam block 34 operates a plurality of control contact sets angularly distributed therearound, four contact sets 40, 42, 44 and 46 being shown in FIG. 2. As shown in FIG. 1, contact set 40 includes an angular stationary contact 48 and a generally S-shaped movable butt contact 50. Horizontal portion 48*a* of stationary contact 40 is electrically connected to or abuts a terminal 52*a* on the upper surface of a control circuitry printed circuit board 52 as shown in FIGS. 1 and 2. Movable contact 50 is electrically connected to or abuts a terminal 52*b* on the lower surface of control circuitry printed circuit board 52 as shown in FIGS. 1 and 2. The upper rounded loop portion 50*a* of movable contact 50 is actuated by a suitable cam integrally molded on actuator block 34. This cam may be a lower cam 34*c* as shown in FIG. 1 for closing normally-open contacts as the block snaps up or an upper cam 34*d* as shown in FIG. 4 for allowing normally-closed contacts to open when the block snaps up. Top plate 34*b* may be secured to the base portion of actuator block 34 by a pair of rivets 34*e* or the like shown in FIG. 2. Base 54 of the pushbutton switch includes a lower portion 54*a*, a midportion 54*b* and an upper portion 54*c* which may be secured to one another by four rivets 56, 58, 60 and 62, screws, or the like, extending vertically therethrough as shown in FIG. 2 with printed circuit board 52 and terminals of movable contacts 50 and stationary contacts 48 being confined or clamped between lower portion 54*a* and midportion 54*b* as shown in FIG. 1. Housing 2 may be connected to top or panel 4 in any suitable manner to mount the pushbutton switch thereon with its pushbutton 6 extending above the upper surface of the panel for depression by the user.

While a double inclined cam and helical springs type of over-center snap-action mechanism has been shown in FIGS. 1–3, it will be apparent that other types of over-center snap-action mechanisms can be used such as, for example, an "M" or "double M" type leafspring or a "Belleville" type spring 64 as schematically illustrated in FIG. 4.

The version of pushbutton switch shown in FIGS. 5 and 6 is similar to that shown in FIGS. 1–4 except that another form of over-center spring is used that provides greater actuator block snap-action travel than a Belleville spring, for example. This form of over-center spring 66 is shown in FIG. 5 along with a cross-section of pushbutton operating shaft 68. To use this form of over-center spring, operating shaft 68 is provided with an annular groove 68*a* therearound as shown in FIG. 6. This flat quadri-compression spring 66 is provided with a flat circuit ring configuration 66*k* as shown in FIG. 5 having four integral compression arms or strips 66*a–d* extending inwardly from points on the ring spaced 90° apart with their inner ends each having a concave configuration for complementary engagement with the round bottom of the annular groove 68*a* on operating shaft 68. Over-center spring 66 also has a small rivet holes 66*e–h* at the root of each compression strip whereby the overcenter spring may be secured by rivets or the like to actuator block 70 as shown in FIG. 6. For this purpose, actuator block 70 is modified from actuator block 34 shown in FIG. 1 by eliminating the upper portion 34*b* and providing suitable rivet holes for securing over-center spring 66 to the upper surface thereof as shown in FIG. 6.

Figure 7:
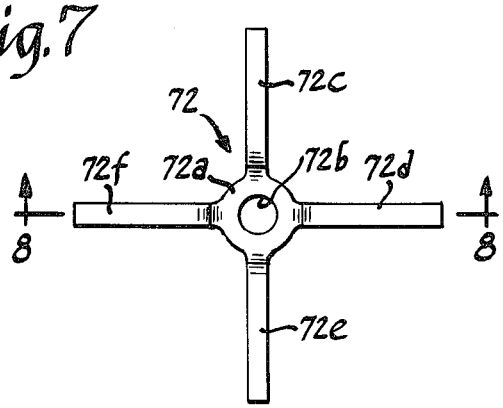
FIG. 7 is an enlarged top view of a preferred form of snap-action spring usable in the switch of FIGS. 1–6.
Figure 8:
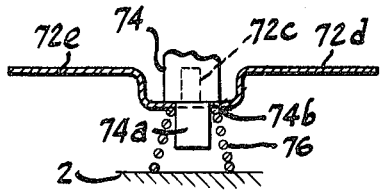
FIG. 8 is a cross-sectional view taken along line 8—8 of FIG. 7 to show the offset arms and with the addition of the lower end portion of a modified plunger shaft and return spring.

Another, preferred form of over-center spring 72 is shown in FIGS. 7 and 8 that provides greater actuator block snap-action travel and longer life than either the aforementioned Belleville spring or flat spring 66 of FIGS. 5 and 6. As shown in FIG. 7, this preferred snap-action spring 72 has a generally flat center portion 72*a* having a center hole 72*b* therethrough for receiving the reduced diameter, lower end portion 74*a* of a pushbutton plunger 74 all the way to shoulder 74*b* as shown in FIG. 8. This snap-action spring 72 also has four intergral upwardly offset arms 72*c*, 72*d*, 72*e* and 72*f* spaced 90° apart that extend outwardly in a plane parallel to the plane of flat center portion 72*a*. It will be apparent that this quadri-compression spring 72 is usable with an actuator block that has a horizontal, circular, inner groove into which the outer tips of arms 72*c–f* are inserted, these arms preferably having a length relative to the diameter of such actuator block groove to retain this spring thereto with some bias. Reduced lower end portion 74*a* of plunger 74 is inserted through hole 72*b* up to shoulder 74*b* and reduced end portion 74*a* is then inserted into the upper, smaller diameter end of frustoconical compression spring 76 whereafter the larger diameter end of the latter abuts the floor of housing 2 as schematically indicated in FIG. 8. While a round hole 72*b* has been shown in FIG. 7, it will be apparent that for non-rotatability, this hole could be a different shape such as square to fit a square reduced lower end portion on the pushbutton plunger.

Figure 9:
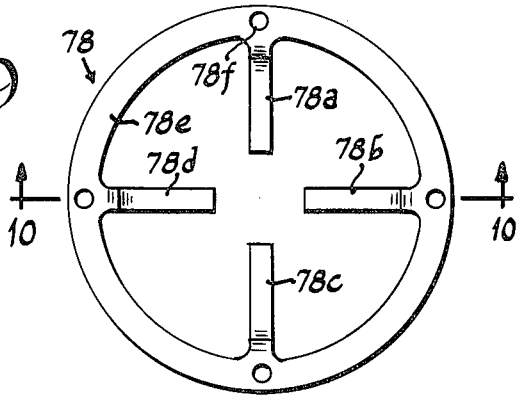
FIG. 9 is an enlarged top view of another form of snap-action spring usable in the switch of FIGS. 1–6.
Figure 10:
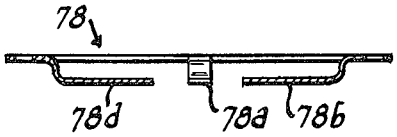
FIG. 10 is a cross-sectional view taken along line 10—10 of FIG. 9 to show the offset arms.

The version of snap-action spring 78 shown in FIGS. 9 and 10 is similar to that shown in FIGS. 5 and 6 except that arms 78*a–d* are offset downwardly into a parallel plane with outer flat circular portion 78*e* to afford the same general orientation between the plunger shaft and the actuator block when the pushbutton is undepressed. The four small holes 78*f* are for riveting this spring to the outer portion of the actuator block similar to the FIGS. 5–6 version. The inner ends of arms 78*a–d*, while shown in FIG. 9 as having a straight across configuration, may have any configuration suitable for the application. For example, they may be concave to fit the annular groove on a round plunger as in FIGS. 5–6, or they may be straight across as in FIG. 9 to fit the groove of a square shaft, or four straight grooves in a round shaft, for non-rotatability between the actuator and plunger.

The offset arms configurations shown in both both the FIGS. 7–8 and FIGS. 9–10 versions are subject to less stress in operation than the flat configuration of FIGS. 5–6 and thus are less subject to breakage in use and afford longer life. Also, this offset configuration affords longer up and down snap-action throw of the actuator block because the bow of the spring can be much bigger than in the flat version. For example, in the practical application disclosed, a throw of as much as 150 thousandths of an inch (3.81 mm) has been attained which is ample to operate the contacts with the actuator block cam action.

In operation, when pushbutton 6 in the version shown in FIGS. 1–3 is depressed, lower portion 30*d* of the double incline cam on the operating shaft slides down between over-center springs 36 and 38. As soon as the high peripheral point between cams 30*d* and 30*c* passes below the center horizontal plane of springs 36 and 38, the tension in these springs causes these springs to snap upwardly along cam 30*c* carrying actuator block 34 with them. During this snap-action upward motion of actuator block 34, cams 50 thereof engage the upper rounded loop portion 50*a* of the movable contacts and force the movable contacts radially outwardly into contact with the upper vertical portions 48*b* of the stationary contacts. If a particular cam on the actuator block is a normally-closed cam such as 34*d* in FIG. 4, this upward snap-action motion of actuator block 34 moves clear of the upper rounded loop 50*a* of the movable contact to allow the tension in the movable contact to cause it to move radially inwardly to separate from the stationary contact and thus open the contacts.

In operation, when pushbutton 6 of the FIGS. 5–6 version is depressed, shaft 68 moves downwardly. Since compression arms 66*a–d* are longer than the radial distance from the peripheral ring 66*k* to shaft 68, compression arms 66*a–d* buckle as the inner ends thereof pass over-center from above the plane of ring 66*k* below such plane and snap actuator block 70 to its upper limit of movement, thereby to actuate the contacts.

Quadri-compression spring 66 imparts longer snap-action travel to the actuator block than a Belleville spring, for example. Since arms 66*a–d* are resilient and will buckle through an S-form when forced over-center, their lengths may be made longer than the radius of a Belleville spring and consequently impart a longer snap-action stroke to the actuator block.

Upon release of the pushbutton, return spring 32 restores shaft 68 and snap spring 66 performs a similar but reverse function to snap the actuator block to its lower limit of travel.

It will be apparent that the switch structure hereinbefore described fulfills the objects stated. For example, the radial motion arrangement of the contacts and the actuator cam block operation provide for a reduced size, compact, multiple contact, snap-action switch having shorter overall height. The shape of the movable contacts along with the actuator cam block combination provide a structure wherein the stresses during operation are kept very low thereby contributing to the long life of the device. The double incline cam and over-center spring snap-action mechanism of FIGS. 1–3 or the quadri-compression spring snap-action mechanism of FIGS. 5–6 are such as to contribute to the long life of the pushbutton switch, and to provide longer actuator block travel. The use of the printed circuit board arrangement as shown in FIGS. 1 and 6 along with the electronic display provide a device that can control a lot of circuitry with one pushbutton switch and therefore provide a display affording more information. The actuator cam block is arranged so with respect to the contact sets that the switch functions can be changed by merely rotating or repositioning the actuator cam block or substituting a different actuator cam block for a particular application, thus eliminating the need for disconnecting wires from the terminals and reconnecting them. Also, this design of actuator cam block affords the use of a large number of contact sets angularly distributed therearound. The radial motion of the movable contacts in response to upward movement of the actuator cam block affords control of the contact pressure very accurately.

While the apparatus hereinbefore described is effectively adapted to fulfill the objects stated, it is to be understood that the invention is not intended to be confined to the particular preferred embodiments of miniature multi-pole double-throw snap-action pushbutton switch with alpha-numeric display disclosed, inasmuch as it is susceptable of various modifications without departing from the scope of the appended claims.

We claim:

1. A miniature multi-pole snap-action pushbutton switch with lighted multi-character display comprising:

an electrically insulating housing having a hole in the top thereof;

a control PC board having a printed circuit thereon and having a hole therein large enough to freely accommodate a snap-action contact actuator means of said switch;

a plurality of contact sets around the periphery of said hole electrically coupled to said printed circuit on said control PC board, each set comprising a stationary contact and a movable contact;

snap-action contact actuator means in said housing concentrically between said contact sets for actuating said movable contacts into or out of engagement with said stationary contacts;

a pushbutton extending out through said hole in the top of said housing;

coupling means coupling said pushbutton to said snap-action contact actuator means for operating the latter upon depression of said pushbutton;

a multi-character display within said pushbutton so as to be visible from the top thereof when lighted;

a display PC board having a hole therein to freely accommodate said pushbutton;

movable contacts mounted on said pushbutton for movement therewith and electrically connected to said display;

stationary contacts mounted on and electrically connected to the printed circuit on said display PC board and contacting said movable contacts throughout the movement of said pushbutton;

and an electric connection between said PC boards enabling at least one of said contact sets to control said display.

2. The miniature multi-pole snap-action pushbutton switch claimed in claim 1, wherein said snap-action contact actuator means comprises:

a vertically movable actuator having cams on its periphery for actuating said movable contacts into engagement with the stationary contacts of the corresponding contact sets;

and over-center snap-action means between said actuator and said coupling means.

3. The miniature multi-pole snap-action pushbutton switch claimed in claim 2, wherein said over-center snap-action means comprises:

a multi-finger over-center leaf spring coupled at its peripheral portion to said actuator and having a plurality of angularly spaced compression fingers extending from said peripheral portion into engagement with said coupling means so that when said pushbutton is depressed said compression fingers will buckle over-center to snap said actuator upwardly.

4. The miniature multi-pole snap-action pushbutton switch claimed in claim 1, wherein:

said coupling means comprises a return spring biased shaft extending from said pushbutton down through said snap-action contact actuator means;

and said snap-action contact actuator means comprises:

an actuator block having peripheral cams that engage said movable contacts to close the same with respect to said stationary contacts;

and a multi-finger compression leaf spring having a peripheral portion coupled to said actuator block and a plurality of radial compression fingers extending from said peripheral portion inwardly into engagement at their inner ends with said shaft and said fingers being longer than the shortest radial distance from said peripheral portion to said shaft so that when said pushbutton is depressed said fingers buckle over-center to snap said actuator from its lower stable position to its upper stable position.

5. The miniature multi-pole snap-action pushbutton switch claimed in claim 4, wherein:

each of said fingers being formed so as to offset said peripheral portion from said inner ends thereby to enhance the throw of said actuator.

6. The miniature multi-pole snap-action pushbutton switch claimed in claim 1, wherein:

each said stationary contact comprises a vertical contacting portion near the edge of said hole in said control PC board facing inwardly of said switch;

each said movable contact comprises a generally S-shaped resilient portion spaced inwardly of said vertical contacting portion of said stationary contact;

and said snap-action contact actuator means comprises a vertically reciprocal actuator block having peripheral cams, one of which engages each said S-shaped resilient portion of said movable contact to cam it outwardly into engagement with said contacting portion of said stationary contact in a given position of said actuator block.

7. The miniature multi-pole snap-action pushbutton switch claimed in claim 6, wherein:

at least one of said peripheral cams is vertically offset from the plane of another one of said cams such that it maintains the associated movable contact normally-closed in the undepressed state of the pushbutton.

8. A miniature multi-pole snap-action pushbutton switch claimed in claim 7, wherein:

another one of said peripheral cams is vertically offset from the plane of said one cam such that it clears the associated movable contact allowing the latter to be normally-open in the undepressed state of the pushbutton and to actuate the associated movable contact closed with respect to the respective stationary contact when the pushbutton is depressed.

9. The miniature multi-pole snap-action pushbutton switch claimed in claim 1, wherein:

said switch also comprises a seal between said top of said housing and said display PC board and having a hole therein the rim of which hugs said pushbutton for environmentally sealing said switch.

10. In a pushbutton switch, a snap-action mechanism comprising:

a pushbutton plunger member having a coupling means at an intermediate point therealong;

a contact actuator block having a clearance hole through which said plunger member freely extends;

abutments above and below said actuator block to limit the vertical movement thereof;

and a unitary snap-action device having a peripheral portion engaging said actuator block and a plurality of radial angularly spaced compression arms extending from said peripheral portion to an inner portion at said coupling means on said pushbutton plunger member such that when said actuator block is at its lower limit and said pushbutton plunger is depressed said arms buckle over-center to snap said actuator block to its upper limit and vice versa;

said pushbutton plunger member being a rod and said coupling means thereon being a groove therearound;

and said snap-action device being an integral leaf spring the peripheral portion of which is a flat ring and said compression arms of which are integral flat offset strips having ends complementary to at least a portion of said groove on said pushbutton plunger rod in which they are pivoted.

11. In a pushbutton switch, a snap-action mechanism comprising:

a pushbutton plunger member having a coupling means at an intermediate point therealong;

a contact actuator block having a clearance hole through which said plunger member freely extends;

abutments above and below said actuator block to limit the vertical movement thereof;

and a unitary snap-action device having a peripheral portion engaging said actuator block and a plurality of radial angularly spaced compression arms extending from said peripheral portion to an inner portion at said coupling means on said pushbutton plunger member such that when said actuator block is at its lower limit and said pushbutton plunger is depressed said arms buckle over-center to snap said actuator block to its upper limit and vice versa;

said pushbutton plunger member being a rod and said coupling means thereon being a shoulder therearound;

and said snap-action device being an integral leaf spring the inner portion of which is a flat center portion having a hole through which the lower end of said rod extends up to said shoulder and said compression arms of which are integral flat strips offset from said center portion and said strips having ends pivotally coupled to said actuator block.

12. In a pushbutton switch, a switch mechanism comprising:

an actuator cam block having limited vertical reciprocating snap-action movement in response to repeated activation of a snap-action mechanism when a spring-biased pushbutton is depressed and released;

cams on the periphery of said actuator cam block;

a PC board having printed circuits thereon and a hole therein the rim of which surrounds said actuator cam block in spaced relation;

and a plurality of movable and stationary contact pairs connected to said printed circuits on said PC board at the edge of said hole for actuation in radial directions by said cams upon said snap-action vertical movement of said actuator cam block.

13. The pushbutton switch mechanism claimed in claim 12, wherein:

said stationary contacts comprises vertical contacting portions facing inwardly;

and said movable contacts comprise generally S-shaped resilient upright portions spaced inwardly from said contact portions for actuation closed by said cams.

* * * * *